US009549240B2

(12) United States Patent
Sohn et al.

(10) Patent No.: US 9,549,240 B2
(45) Date of Patent: Jan. 17, 2017

(54) MOBILE TERMINAL AND METHOD OF PAIRING MOBILE TERMINAL WITH HEARING APPARATUS

(71) Applicant: Samsung Electronics Co., Ltd., Suwon-si (KR)

(72) Inventors: Jun Il Sohn, Yongin-si (KR); See Youn Kwon, Seoul (KR); Yang Wook Kim, Hwaseong-si (KR); Hee Suk Shin, Daejeon (KR); Jun Whon Uhm, Anyang-si (KR); Ju Hwan Woo, Suwon-si (KR); Jong Min Choi, Seoul (KR); Jong Hee Han, Seoul (KR); Dong Wook Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 153 days.

(21) Appl. No.: 14/328,537

(22) Filed: Jul. 10, 2014

(65) Prior Publication Data

US 2015/0163585 A1 Jun. 11, 2015

(30) Foreign Application Priority Data

Dec. 6, 2013 (KR) ..... 10-2013-0151782

(51) Int. Cl.
*H04R 25/00* (2006.01)
*H04R 1/10* (2006.01)

(52) U.S. Cl.
CPC ..... *H04R 1/1091* (2013.01); *H04R 25/554* (2013.01); *H04R 2420/07* (2013.01)

(58) Field of Classification Search
CPC ..... H04R 1/10; H04R 1/1091; H04R 25/00; H04R 25/55; H04R 25/554; H04R 2420/00; H04R 2420/07
See application file for complete search history.

(56) References Cited

U.S. PATENT DOCUMENTS

| | | | | |
|---|---|---|---|---|
| 2007/0071264 | A1* | 3/2007 | Baechler et al. | 381/315 |
| 2011/0246909 | A1* | 10/2011 | Berrett et al. | 715/753 |
| 2013/0101149 | A1 | 4/2013 | Maenpaa | |
| 2014/0220897 | A1* | 8/2014 | Wan | 455/41.2 |
| 2015/0105014 | A1* | 4/2015 | Kulavik et al. | 455/41.1 |
| 2015/0133051 | A1* | 5/2015 | Jamal-Syed et al. | 455/41.2 |
| 2015/0162994 | A1* | 6/2015 | Rodzevski et al. | H04B 13/005 |

* cited by examiner

*Primary Examiner* — Thang Tran
(74) *Attorney, Agent, or Firm* — NSIP Law

(57) ABSTRACT

Disclosed are a terminal and a method of pairing a terminal with a hearing apparatus. The method of pairing a terminal involves verifying whether a hearing apparatus is in contact with a terminal, and pairing the terminal with the hearing apparatus in response to a determination that the hearing apparatus is in contact with the terminal.

22 Claims, 9 Drawing Sheets

MOBILE TERMINAL AND METHOD OF PAIRING MOBILE TERMINAL WITH HEARING APPARATUS

CROSS-REFERENCE TO RELATED APPLICATION(S)

This application claims the benefit under 35 USC 119(a) of Korean Patent Application No. 10-2013-0151782 filed on Dec. 6, 2013, in the Korean Intellectual Property Office, the entire disclosure of which is incorporated herein by reference for all purposes.

BACKGROUND

1. Field

The following description relates to a terminal and a method of pairing a terminal with a hearing apparatus.

2. Description of Related Art

Recently, wireless communications technology is applied to hearing apparatuses such as hearing aids. For instance, products capable of manipulating hearing apparatuses with a wireless remote control are being produced.

However, remote controls are expensive and cumbersome for users to carry around. On the other hand, most users carry around a portable terminal such as a mobile phone. Thus, a method of controlling a hearing apparatus that uses a portable terminal may prove to be convenient for most users.

To control a hearing apparatus with a terminal, the terminal needs to be paired with the hearing apparatus. A conventional pairing method may involve changing the mode of a terminal that is to be paired to a pairing mode, searching for a pairable terminal from a hearing apparatus, selecting the terminal that is to be paired among terminals that are found by the hearing apparatus, and pairing the selected terminal with the hearing apparatus. Thus, people who frequently use hearing apparatuses, such as elderly people and people with disabilities, often find the pairing method to be complex and cumbersome. Accordingly, a simpler method of pairing a terminal with a hearing apparatus is desirable.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a method of pairing a terminal involves verifying whether a hearing apparatus is in contact with a terminal, and pairing the terminal with the hearing apparatus in response to a determination that the hearing apparatus is in contact with the terminal.

The verifying may involve determining that the hearing apparatus is in contact with the terminal in response to detecting a magnetic field induced by the hearing apparatus.

The verifying may involve detecting a contact of the hearing apparatus through a touch screen of the terminal.

The verifying may involve, in response to the terminal detecting a contact different from a contact with a body of a user, transmitting a hearing apparatus identifying signal and determining that the hearing apparatus is in contact with the terminal after receiving a reply signal from the hearing apparatus.

The method may further involve determining whether the terminal is able to use a pairing function, in which the pairing is performed in response to a determination that the terminal is able to use the pairing function.

The determining may involve determining that the terminal is not able to use the pairing function in response to a determination that the terminal is performing an application unrelated to the pairing.

The determining may involve determining that the terminal is not able to use the pairing function in response to a determination that the pairing function of the terminal is in an off state.

The method may further involve setting the pairing function of the terminal to be in an on state in response to the pairing function of the terminal being in an off state and determining that the terminal is able to use the pairing function.

The pairing may involve transmitting a pairing attempt signal from the terminal and pairing the terminal with a hearing apparatus responding to the pairing attempt signal.

In another general aspect, a method of pairing a terminal involves verifying whether an image taken by a terminal comprises a hearing apparatus or information associated with the hearing apparatus, and pairing the terminal with the hearing apparatus in response to the image taken by the terminal comprising the hearing apparatus or the information associated with the hearing apparatus.

The information associated with the hearing apparatus may include at least one of a quick response code, a barcode, an advertisement, and an image on a storage case of the hearing apparatus.

The pairing may involve identifying a type of the hearing apparatus using the image taken by the terminal, transmitting a pairing attempt signal corresponding to the identified type, and pairing the terminal with a hearing apparatus responding to the pairing attempt signal.

The image may be taken by a single lens camera of the terminal that is not an infrared camera.

In another general aspect, a non-transitory computer-readable storage medium includes a program comprising instructions to cause a computer to perform the method described above.

In yet another general aspect, a terminal includes a hearing apparatus contact verifier configured to verify whether a hearing apparatus is in contact with the terminal, and a pairing unit configured to pair the terminal with the hearing apparatus in response to the hearing apparatus being in contact with the terminal.

The hearing apparatus contact verifier may be configured to determine that the hearing apparatus is in contact with the terminal in response to a magnetic field induced by a magnet disposed in the hearing apparatus being detected by a magnetic sensor.

The hearing apparatus contact verifier may be configured to verify whether the hearing apparatus is in contact with the terminal in response to a touch being detected through a touch screen of the terminal.

The hearing apparatus contact verifier may be configured to, in response to detecting the touch through the touch screen, determine whether the touch is different from a contact with a body of a user and transmit a hearing apparatus identifying signal in response to a determination that the touch is different.

The terminal may further include a pairing function determiner configured to determine whether the terminal is able to use a pairing function, in which the pairing unit may be configured to pair the terminal with the hearing apparatus in response to the pairing function determiner determining that the terminal is able to use the pairing function.

In another general aspect, a terminal includes a camera, an image verifier configured to verify whether an image taken by the camera includes a hearing apparatus or information associated with the hearing apparatus, and a pairing unit configured to pair the terminal with the hearing apparatus in response to the image verifier determining that the image taken by the camera includes the hearing apparatus or the information associated with the hearing apparatus.

The camera may be a single lens camera that is not an infrared camera.

The information associated with the hearing apparatus may include at least one of a quick response code, a barcode, an advertisement, and an image on a storage case of the hearing apparatus.

The terminal may further include an image verifier configured to receive information on a type of the hearing apparatus from a server.

Other features and aspects will be apparent from the following detailed description, the drawings, and the claims.

Figure 1:
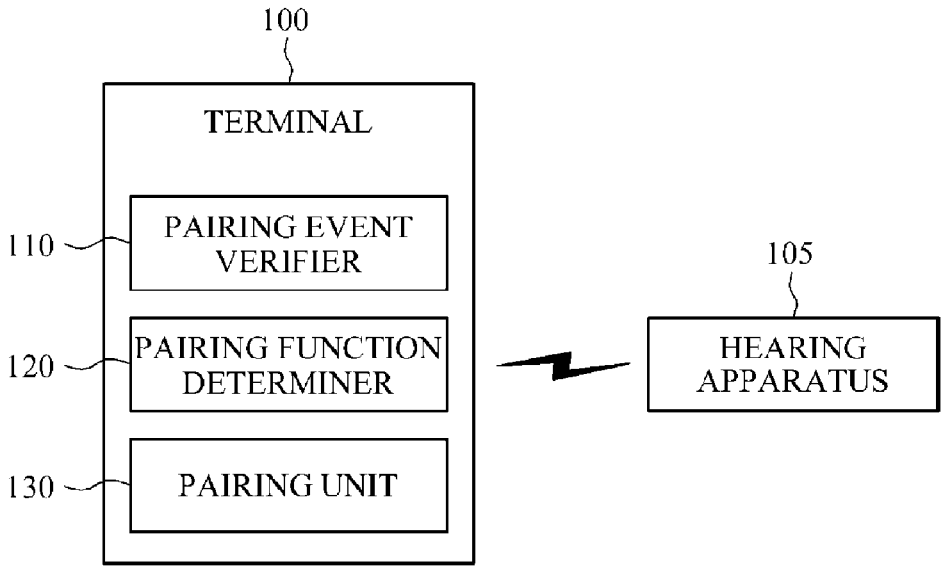
FIG. 1 is a diagram illustrating an example of a terminal.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

Throughout the drawings and the detailed description, the same reference numerals refer to the same elements. The drawings may not be to scale, and the relative size, proportions, and depiction of elements in the drawings may be exaggerated for clarity, illustration, and convenience.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

FIG. 1 is a diagram illustrating an example of a terminal 100.

Referring to FIG. 1, the terminal 100 that is to be paired with a hearing apparatus 105 includes a pairing event verifier 110, a pairing function determiner 120, and a pairing unit 130.

The terminal 100 may refer to a mobile communication terminal that may be paired with the hearing apparatus 105 and in which an application controlling the hearing apparatus 105 may be installed. For example, the terminal 100 may be one of a smartphone, a tablet computer, a portable moving pictures experts group layer 3 (MP3) player, and a smart watch. The hearing apparatus 105 may refer to a hearing impairment compensating device that may collect voice signals around an ear of a user, compensate for the collected voice signals based on auditory characteristics of the user, and provide the compensated signals to the user by amplifying the signals to compensate for hearing loss.

The pairing event verifier 110 may verify whether a pairing event that allows the terminal 100 and the hearing apparatus 105 to be paired has occurred.

For example, the pairing event may be one of a contact between the terminal 100 and the hearing apparatus 105, an image generated by photographing the hearing apparatus 105 or information associated with the hearing apparatus 105 by the terminal 100, and execution of an application related to pairing in the terminal 100. The image may be taken by a mono camera provided on the terminal 100. A mono camera refers to a single lens camera provided on many mobile devices, such as smart phones. Such a mono camera is not an infrared camera used for detecting motion in motion detectors. While an infrared camera may be used in another example, in this example, the use of the mono camera reduces the manufacturing cost involved in installing an infrared camera in a mobile terminal.

In the event that the pairing event verifier 110 verifies a pairing event has taken place, the pairing function determiner 120 may determine whether the terminal 100 is in a pairable state.

The terminal 100 may perform various functions in addition to being paired with the hearing apparatus 105. In addition, the terminal 100 may be used to control the paired hearing apparatus 105. Based on a function performed by the terminal 100, the pairing may not be performed concurrently with the function. Thus, the pairing function determiner 120 may determine whether the terminal 100 is in a pairable state.

For example, in the event that the pairing with the hearing apparatus 105 is performed during a terminal 100 that is performing a call function or an application unrelated to the pairing such as, for example, a game, the pairing may interfere with the application that is being performed. Thus, in the event that the terminal 100 is performing an application unrelated to the pairing, the pairing function determiner 120 may determine that the terminal 100 is not in a pairable state.

In addition, the pairing function of the terminal 100 such as a Bluetooth pairing function, for example, may be in an off state based on the settings set by the user. In the event that the pairing function of the terminal 100 is in an off state, the pairing between the terminal 100 and peripheral devices including the hearing apparatus 105 may not be enabled. Thus, in the event that the pairing function is in an off state, the pairing function determiner 120 may determine that the terminal 100 is not able to use the pairing function.

However, in the event that the pairing function of the terminal 100 is in an off state and the pairing function determiner 120 is granted a permission to control the pairing function of the terminal 100, the pairing function determiner 120 may set the pairing function of the terminal 100 so as to be turned on and may then determine that the terminal 100 is in a pairable state.

In response to the pairing event verifier 110 verifying that a pairing event has taken place, the pairing unit 130 may pair the terminal 100 with the hearing apparatus 105 that is associated with the pairing event. The pairing unit 130 may attempt to pair with the hearing apparatus 105 only in the event that the pairing function determiner 120 determines that the terminal 100 is in a pairable state.

The pairing unit 130 may transmit a pairing attempt signal. In response to receiving the pairing attempt signal, among hearing apparatuses that receive the pairing attempt signal, a hearing apparatus 105 that is in a pairable state may transmit a reply signal to the terminal 100.

Subsequently, the terminal 100 may be paired with the hearing apparatus 105 that has transmitted the replay signal in response to the pairing attempt signal from the terminal 100.

However, in the event that the pairing is performed at a store where a plurality of hearing apparatuses are sold or at a meeting of hearing-impaired people who are using the hearing apparatuses, a plurality of hearing apparatuses may be in a pairable state with the terminal 100 when the pairing attempt signal is transmitted by the pairing unit 130 of the terminal 100.

In such an event, the pairing unit 130 may selectively perform the pairing by selecting one hearing apparatus from among a plurality of hearing apparatuses that are transmitting the reply signal in response to the pairing attempt signal based on a predetermined priority.

For example, in the event that the pairing event indicates that the hearing apparatus 105 is in contact with the terminal 100, the hearing apparatus 105 in contact with the terminal 100 may be a hearing apparatus desired for pairing. Thus, the pairing unit 130 may perform the pairing by selecting the hearing apparatus 105 disposed closest to the terminal 100 from among the hearing apparatuses that transmitted the reply signal in response to the pairing attempt signal.

In addition, in the event that the pairing event is associated with an image generated by photographing the hearing apparatus 105 or information associated with the hearing apparatus 105 by the terminal 100, the pairing event verifier 110 may identify a type of the hearing apparatus 105 using the generated image. The pairing unit 130 may perform the pairing by selecting the hearing apparatus 105 of the type identified by the pairing event verifier 110 from among the hearing apparatuses transmitting the reply signal in response to the pairing attempt signal. In the event that there are a plurality of hearing apparatuses of the type identified by the pairing event verifier 110 among the hearing apparatuses transmitting the reply signal in response to the pairing attempt signal, the pairing unit 130 may perform the pairing by selecting the hearing apparatus 105 disposed closest to the terminal 100 from among the hearing apparatuses of the type identified by the pairing event verifier 110.

In yet another example, in the event that there are a plurality of hearing apparatuses that are in a pairable state in response to a pairing attempt signal of a terminal 100, the terminal 100 may allow the user to select a hearing apparatus 105 that the user wants to pair with the terminal 100. For example, the user may identify the hearing apparatus 105 that the user wants to pair with the terminal 100 through a user interface on a display screen of the terminal 100 or by using a voice command.

Figure 2:
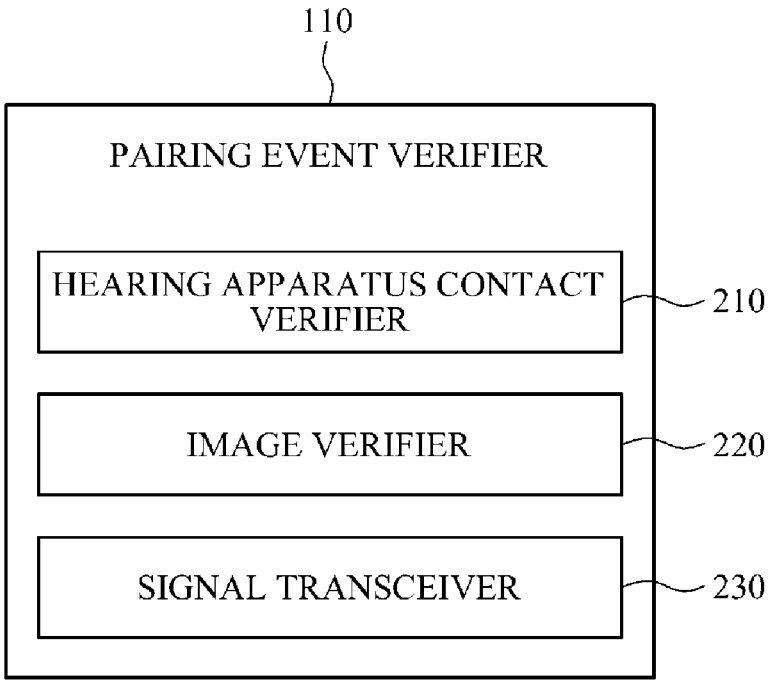
FIG. 2 is a diagram illustrating an example of a pairing event verifier in a terminal.

FIG. 2 is a diagram illustrating an example of a pairing event verifier 110. The example of the pairing event verifier 110 may be included in the terminal 100 illustrated in FIG. 1.

Referring to FIG. 2, the pairing event verifier 110 includes a hearing apparatus contact verifier 210, an image verifier 220, and a signal transceiver 230.

The hearing apparatus contact verifier 210 may verify whether a hearing apparatus 105 is in contact with a terminal 100. In the event that the hearing apparatus 105 is in contact with the terminal 100, the hearing apparatus contact verifier 210 may determine that a pairing event has occurred.

For example, the hearing apparatus contact verifier 210 may include a magnetic sensor to detect a magnetic field. In response to the magnetic sensor detecting the magnetic field induced by a magnet disposed inside a hearing apparatus 105, the hearing apparatus contact verifier 210 may determine that the hearing apparatus 105 is in contact with the terminal 100. However, the hearing apparatus contact verifier 210 is not limited thereto. In another example, without a magnet provided inside the hearing apparatus 105, the magnetic sensor may be capable of detecting the magnetic field induced by the flow of current inside a hearing apparatus 105.

The image verifier 220 may verify whether an image taken by the terminal 100 includes the hearing apparatus 105 or information associated with the hearing apparatus 105. In the event that the image includes the hearing apparatus 105 or the information associated with the hearing apparatus 105, the pairing event verifier 110 may determine that a pairing event has occurred. The information associated with the hearing apparatus 105 may include at least one of a quick response (QR) code, a barcode, an advertisement, and an image on a storage case of the hearing apparatus 105 or on the hearing apparatus 105. That is, an image, a barcode or the like may be provided on the storage container for storing the hearing apparatus 105.

The image verifier 220 may compare the image taken by the terminal 100 to sample images of hearing apparatuses, for example, a front view, a side view, a top view, a bottom view, and a rear view, and may verify whether the image taken by the terminal 100 includes the hearing apparatus 105. The image verifier 220 may store the sample images or may request the images from a related server.

In addition, in the event that the image taken by the terminal 100 includes at least one of the QR code, the barcode, the advertisement, and the image on the storage case of a hearing apparatus, the image verifier 220 may transmit the QR code, the barcode, the advertisement, or the image on the storage case to a server related to the hearing apparatus 105, and may verify whether information included in the image is associated with the hearing apparatus 105. In this example, in response to the information included in the image is associated with the hearing apparatus 105, the image verifier 220 may receive information on a type of the hearing apparatus 105 from the server.

The signal transceiver 230 may transmit a hearing apparatus identifying signal in response to an application related to the pairing being executed in the terminal 100. Also, the signal transceiver 230 may transmit the hearing apparatus identifying signal at a predetermined time interval. The predetermined time interval may be determined based on a time interval during which battery consumption is minimized and pairing is enabled, or changed by the user. The hearing apparatus identifying signal may refer to a radio frequency (RF) signal enabling the hearing apparatus 105 to receive the hearing apparatus identifying signal and to transmit a reply signal in response to the received signal.

Also, the signal transceiver 230 may identify a form of an object in contact with a touch display of the terminal 100. In response to the identified form being determined to be different from a form of a finger of the user as a result of the identification, the signal transceiver 230 may transmit the hearing apparatus identifying a signal.

For example, in the event that the user touches the touch display of the terminal 100 with a finger, the form of the object detected by the terminal 100 may be a circular or an oval form. In the event that the user places the hearing apparatus 105 in contact with the touch display of the terminal 100, the form of the object detected by the terminal 100 may correspond to a form of the hearing apparatus 105 differing from the circular or the oval form. In this example, in lieu of the contact verifier 210, the signal transceiver 230 may transmit the hearing apparatus identifying signal and may verify whether the hearing apparatus 105 is in contact with the terminal 100.

Based on a size of a magnet, a number of magnets, a material and thickness of an outer case of a hearing apparatus 105, and the like, the hearing apparatus 105 may not emit magnetic field externally or may not emit magnetic field of sufficient magnitude to be detected by a magnetic sensor. However, the signal transceiver 230 may detect a contact between a terminal and a hearing apparatus that does not emit sufficient magnetic field to be detected by the magnetic sensor by sensing a touch of the contacted hearing apparatus and transmitting the hearing apparatus identifying signal. The signal transceiver 230 may limit an output of the hearing apparatus identifying signal such that the hearing apparatus identifying signal has a magnitude that is less than or equal to a predetermined magnitude. By controlling the magnitude of the hearing apparatus identifying signal, only a hearing apparatus 105 that is positioned within a predetermined distance from the terminal 100 receives the hearing apparatus identifying signal. Thus, the desired hearing apparatus 105 is likely to receive the hearing apparatus identifying signal.

Also, the signal transceiver 230 may receive the reply signal from the hearing apparatus 105. In the event that the reply signal is received from the hearing apparatus 105, the signal transceiver 230 may determine that the pairing event has occurred. Also, the signal transceiver 230 may identify, based on a type of the reply signal, a type of the hearing apparatus 105 transmitting the reply signal and may forward the identified type to a pairing unit 130.

Figure 3:
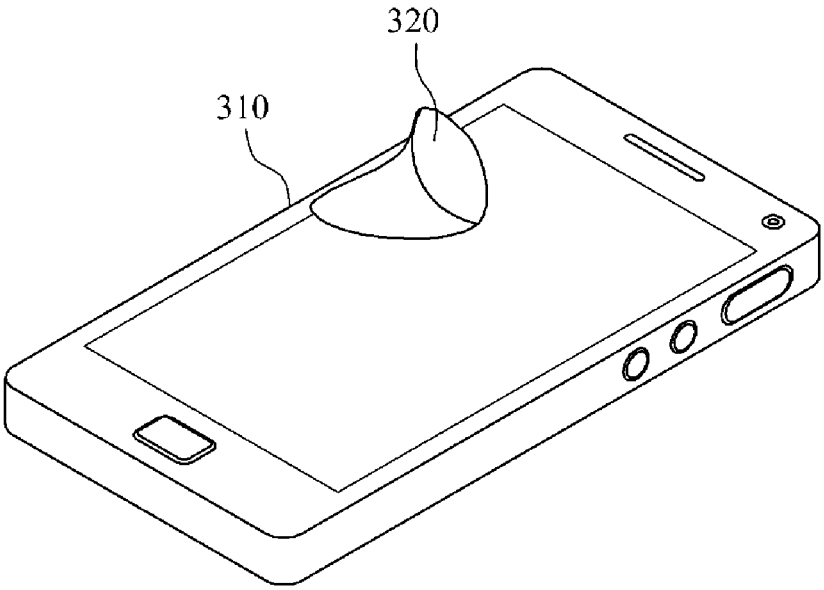
FIG. 3 illustrates an example of a method of pairing a terminal with a hearing apparatus.

FIG. 3 illustrates an example of a method of pairing a terminal 310 with a hearing apparatus 320 that is in contact with the terminal 310.

As illustrated in FIG. 3, a user may place a hearing apparatus 320 in contact with a terminal 310.

The terminal 310 may detect a magnetic field of a magnet disposed in the hearing apparatus 320 and may verify that the hearing apparatus 320 is in contact.

Also, the terminal 310 may determine whether an object other than a finger of the user is in contact based on a shape of the hearing apparatus 320 that is in contact with a touch display unit of the terminal 310 and may transmit a hearing apparatus identifying signal.

The touch display unit may detect the touch by applying one or more technologies. For example, the touch display unit may include a resistive touch screen, a surface acoustic wave touch screen, a capacitive touch screen, an optical imaging (infrared lights) touch screen, or the like.

The hearing apparatus 320 that is receiving the hearing apparatus identifying signal may transmit a reply signal to the terminal 310. The terminal 310 that receives the reply signal may determine that the hearing apparatus 320 is in contact with the terminal 310.

Subsequently, the terminal 310 may be paired with the hearing apparatus 320 that is in contact with the terminal 310.

As described with reference to FIG. 3, the terminal 310 and the hearing apparatus 320 may be paired with each other simply by placing the terminal 310 in contact with the hearing apparatus 320 that is to be paired with the terminal 310, without additional settings. Thus, the user may conveniently achieve pairing by simply placing the hearing apparatus 320 in contact with the terminal 310.

Figure 4:
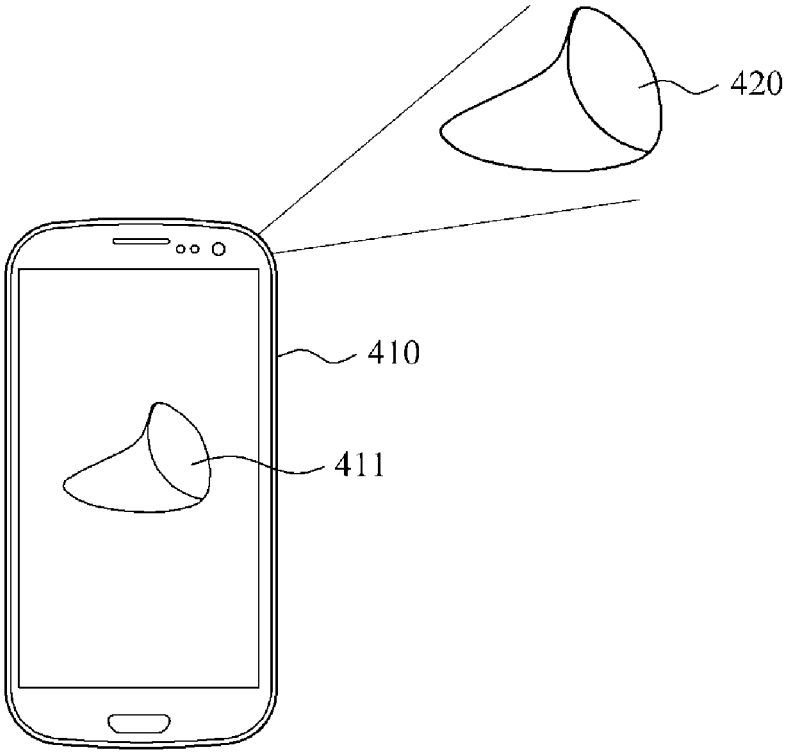
FIG. 4 illustrates another example of a method of pairing a terminal with a hearing apparatus.

FIG. 4 illustrates an example of a method of pairing a terminal 410 with a hearing apparatus 420 based on an image 411 of the hearing apparatus 420.

Referring to FIG. 4, the image 411 may be generated by photographing the hearing apparatus 420 with a camera of the terminal 410.

The terminal 410 may verify whether the image 411 includes the hearing apparatus 420.

In the event that the image 411 includes the hearing apparatus 420 as illustrated in FIG. 4, the terminal 410 may be paired with the hearing apparatus 420.

However, there may be an event in which a plurality of pairable devices, in addition to the hearing apparatus 420, may be positioned within a pairable distance from the terminal 410. In such an event, the terminal 410 may identify a type of the hearing apparatus 420 using the image 411 and may transmit a pairing attempt signal. The terminal 410 may select the hearing apparatus 420 and may pair with the hearing apparatus 420 based on the reply signal. In the event that there are multiple reply signals, the terminal 410 may also select the hearing apparatus 420 from among the devices that transmitted the reply signals based on the identified type of the hearing apparatus 420, and thus pair with the desired hearing apparatus 420.

As described with reference to FIG. 4, the user may pair the desired hearing apparatus 420 with a terminal 410 by photographing with the terminal 410 the hearing apparatus 420 that the user desires to pair with the terminal 410, without additional settings.

Figure 5:
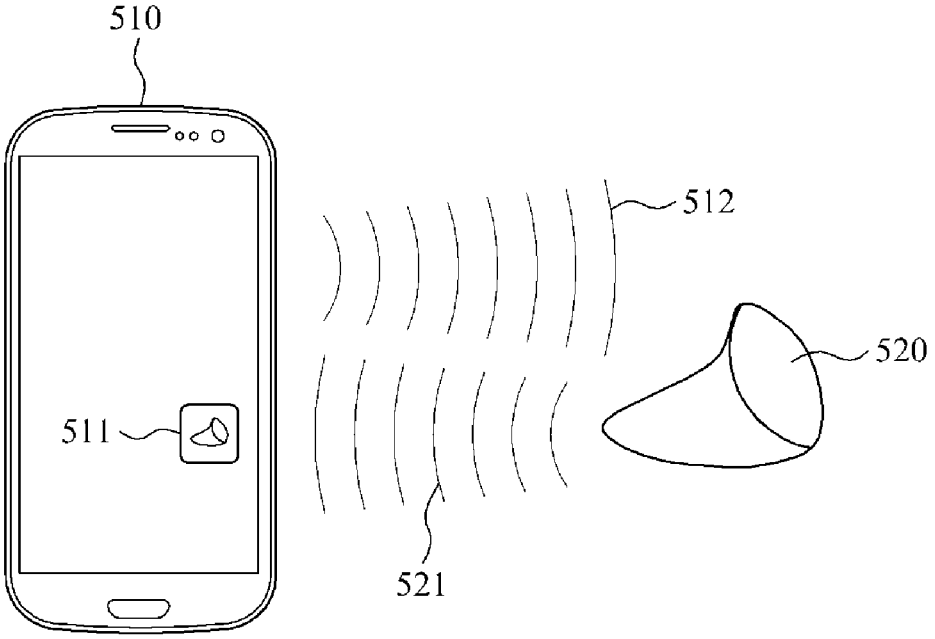
FIG. 5 illustrates yet another example of a method of pairing a terminal with a hearing apparatus.

FIG. 5 illustrates an example of a method of pairing a terminal 510 with a hearing apparatus 520 using a signal.

As illustrated in FIG. 5, the terminal 510 and the hearing apparatus 520 may be paired with each other in response to a user executing an application 511 related to pairing in the terminal 510.

In response to the application 511 being executed, the terminal 510 may transmit a hearing apparatus identifying signal 512.

In response, the hearing apparatus 520 that receives the hearing apparatus identifying signal 512 may transmit a reply signal 521 to the terminal 510.

Subsequently, the terminal 510 that receives the reply signal 521 may be paired with the hearing apparatus 520 that transmitted the reply signal 521.

As described with reference to the example illustrated in FIG. 5, a user may pair a terminal 510 and a hearing apparatus 520 that are positioned within an appropriate distance from the terminal 510 by simply executing an application 511 on the terminal 510, without manipulating additional settings. For example, the application may be executed by manipulating an icon on a touch screen of the terminal 510. Thus, the user may conveniently achieve the pairing between the hearing apparatus 520 and the terminal 510.

Figure 6:
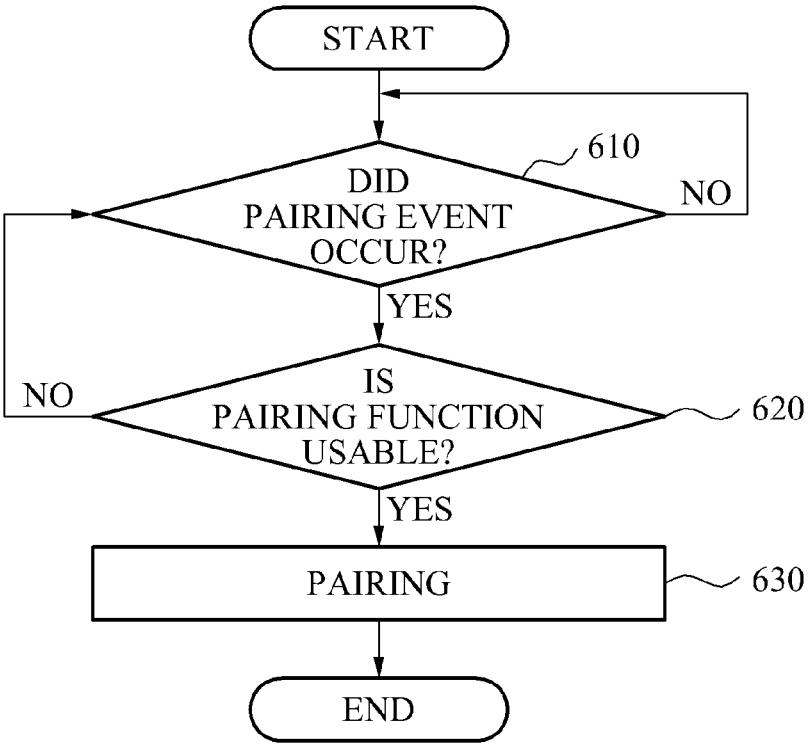
FIG. 6 is a flowchart illustrating an example of a method of pairing a terminal with a hearing apparatus.

FIG. 6 is a flowchart illustrating an example of a method of pairing a terminal and a hearing apparatus.

In 610, a pairing event verifier 110 may verify whether a pairing event that allows a terminal 100 and a hearing apparatus 105 to be paired with each other has occurred.

The pairing event verifier 110 may verify whether any one of pairing events, for example, a contact between the terminal 100 and the hearing apparatus 105, an image generated by photographing the hearing apparatus 105 or information associated with the hearing apparatus 105, and an execution of a pairing related application in the terminal 100, has occurred.

In the event that the pairing event verifier 110 determines that a pairing event has not occurred, the pairing event verifier 110 may continuously perform 610 until the pairing event occurs. That is, the pairing event verifier 110 may be continuously monitoring the occurrence of a pairing event. In the event that the pairing event verifier 110 verifies that a pairing event has occurred, a pairing function determiner 120 may perform 620.

In 620, the pairing function determiner 120 may determine whether a pairing function of the terminal 100 is in a usable state. That is, the pairing function determiner 120 determines whether the terminal 100 is in a pairable state.

In the event that the terminal 100 is performing a call function or an application unrelated to the pairing such as, for example, a game, the pairing function determiner 120 may determine that the terminal 100 is not in a state to use the pairing function of the terminal 100.

Also, in response to the pairing function of the terminal 100 such as, for example, a Bluetooth pairing function, is in an off state in accordance with the settings set by the user in advance, the pairing function determiner 120 may determine that the pairing function of the terminal 120 is not in a state to be used.

In the event that the terminal 100 is not in a state to use the pairing function, the pairing function determiner 120 may terminate the operation and the pairing event verifier 110 may continuously perform 610. Conversely, in the event that the terminal 100 is in a state to perform the pairing function, a pairing unit 130 may perform 630.

In 630, the pairing unit 130 may pair the terminal 100 with the hearing apparatus 105 associated with the pairing event verified in 610.

For example, the pairing unit 130 may transmit a pairing attempt signal. Among one or more hearing apparatuses that receive the pairing attempt signal from the pairing unit 130, a pairable hearing apparatus may transmit a reply signal to the terminal 100, while other hearing apparatuses, if any, does not transmit a reply signal.

Subsequently, the terminal 100 may be paired with the hearing apparatus 105 that transmitted the reply signal in response to the pairing attempt signal.

However, in the event that the pairing is performed in a store where a plurality of hearing apparatuses are sold or at a meeting of hearing-impaired people who are using the hearing apparatuses, numerous pairable hearing apparatus may be found in response to the pairing attempt signal. In such an event, the pairing unit 130 may select a desired hearing apparatus 105 from among the many hearing apparatuses that are transmitting the reply signal in response to the pairing attempt signal based on a predetermined priority, so that the pairing unit 130 may be paired with the selected hearing apparatus 105.

In response to the pairing event indicating the image generated by photographing the hearing apparatus 105 or information associated with the hearing apparatus 105 by the terminal 100, the pairing event verifier 110 may identify a type of the hearing apparatus 105 using the generated image. In addition, the pairing unit 130 may select the hearing apparatus 105 of the type identified by the pairing event verifier 110 from among the plurality of hearing apparatuses that are transmitting the reply signal in response to the pairing attempt signal and may pair the terminal 100 with the hearing apparatus 105. In the event that a plurality of hearing apparatuses of the type identified by the pairing event verifier 110 are present among the hearing apparatuses that are transmitting the reply signal in response to the pairing attempt signal, the pairing unit 130 may select the hearing apparatus 105 disposed closest to the terminal 100 from among the hearing apparatuses of the type identified by the pairing event verifier 110.

Figure 7:
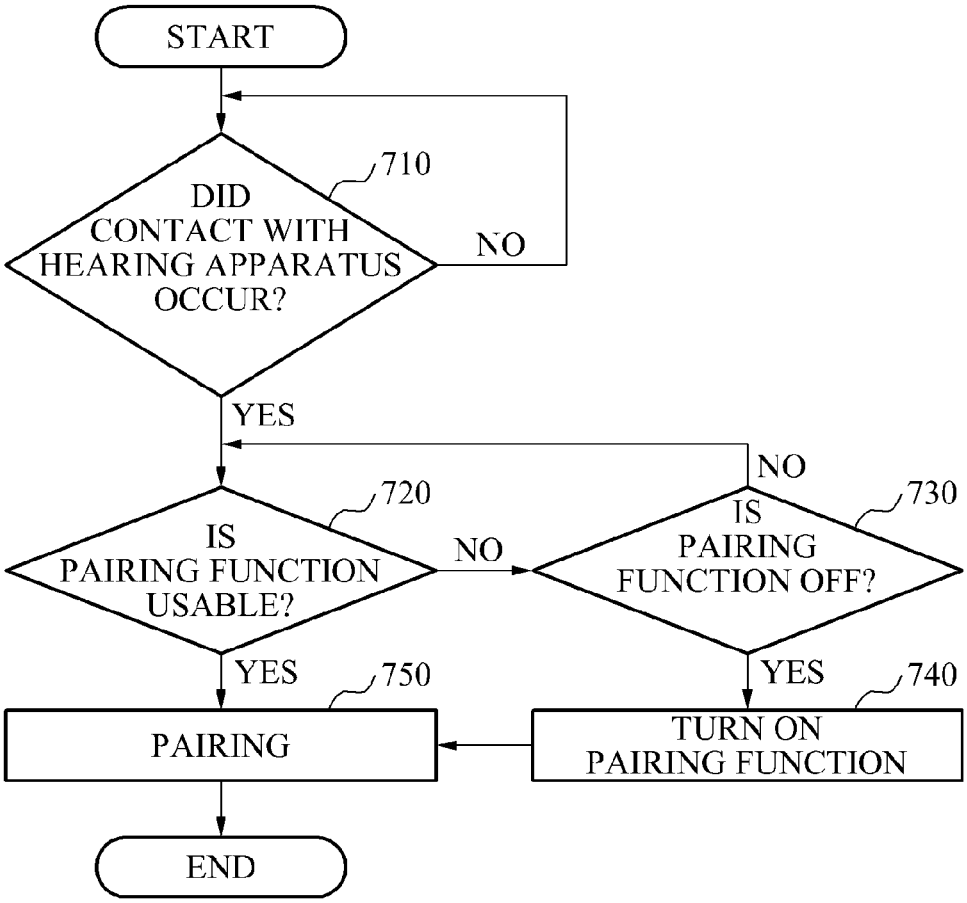
FIG. 7 is a flowchart illustrating another example of a method of pairing a terminal with a hearing apparatus.

FIG. 7 is a flowchart illustrating an example of a method of pairing a terminal with a hearing apparatus. The method of pairing the terminal illustrated FIG. 7 is based on detecting a contact with the hearing apparatus 105. The pairing method may be used with the terminal 100 illustrated in FIG. 1.

In 710, the hearing apparatus contact verifier 210 of FIG. 2 may verify whether the hearing apparatus 105 is in contact with the terminal 100.

The hearing apparatus contact verifier 210 may include a magnetic sensor to detect a magnetic field. In the event that the magnetic sensor detects the magnetic field induced by a magnet disposed inside the hearing apparatus 105, the hearing apparatus contact verifier 210 may determine that the hearing apparatus 105 is in contact with the terminal 100.

In the event that the hearing apparatus contact verifier 210 determines that a contact with a hearing apparatus 105 did not occur, the hearing apparatus contact verifier 210 may continuously perform 710 until it is determined that a hearing apparatus 105 is in contact with the terminal 100. In addition, in the event that the hearing apparatus contact verifier 210 determines a hearing apparatus 105 is in contact with the terminal 100, a pairing function determiner 120 may perform 720.

In 720, the pairing function determiner 120 may determine whether the terminal 100 is in a condition to use a pairing function of the terminal 100. In other words, the pairing function determiner 120 determines whether the terminal 100 is in a pairable state.

In the event that the terminal 100 is performing a call function or is executing an application unrelated to the pairing such as, for example, a video game application, the pairing function determiner 120 may determine that the terminal 100 is not in a condition to use the pairing function, and is not in a pairable condition.

In addition, in the event that the pairing function of the terminal 100, for example, a Bluetooth pairing function, is in an off state in accordance with the settings set by the user in advance, the pairing function determiner 120 may determine that the terminal 100 is not in a condition to use the pairing function and is not in a pairable condition.

In the event that the terminal 100 is not in a condition to use the pairing function, the pairing function determiner 120 may perform 730. Also, in the event that the terminal 100 is in a pairable condition, a pairing unit 130 may perform 750.

In the event that the terminal 100 is not able to use the pairing function because the terminal 100 is performing a call function or is executing an application unrelated to pairing such as, for example, a video game application, the terminal 100 may wait until the call function or the application is terminated. However, in the event that the pairing function of the terminal 100 is in the off state, the pairing function of the terminal 100 may be used by simply turning on the pairing function without a delay.

Thus, in 730, the pairing function determiner 120 may verify whether the pairing function of the terminal 100 is in the off state.

In response to the pairing function of the terminal 100 not being in an off state, the pairing function determiner 120 may terminate the operation, and the pairing event verifier 110 may continuously perform 720. That is, the pairing function determiner 120 may continually determine whether the terminal 100 is in a condition to use the pairing function of the terminal 100. Also, the pairing function determiner 120 may wait until the call function or the application is terminated. In the event that the pairing function of the terminal 100 is in an off state, the pairing function determiner 120 may perform 740.

In 740, the pairing function determiner 120 may turn on the pairing function of the terminal 100 and may then determine that the terminal 100 is in a condition to use the pairing function.

In 750, the pairing unit 130 may pair the terminal 100 with the hearing apparatus 105 in contact with the terminal 100 in 710.

The pairing unit 130 may transmit a pairing attempt signal. In this example, in response to the received pairing attempt signal, among one or more hearing apparatuses that receive the pairing attempt signal, a pairable hearing apparatus may transmit a reply signal to the terminal 100.

Subsequently, the terminal 100 may be paired with the hearing apparatus 105 that transmitted the reply signal.

Figure 8:
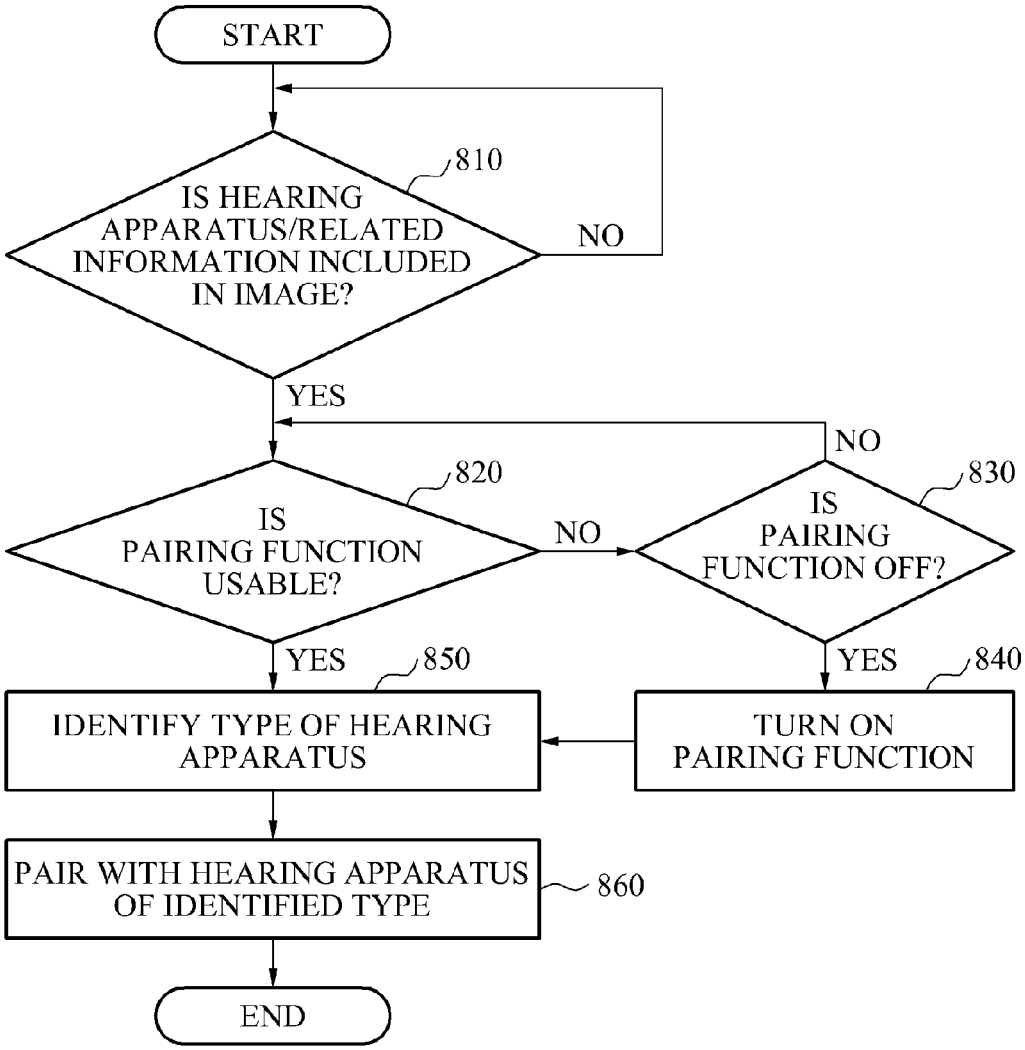
FIG. 8 is a flowchart illustrating yet another example of a method of pairing a terminal with a hearing apparatus.

FIG. 8 is a flowchart illustrating another example of a method of pairing a terminal with a hearing apparatus. This example of pairing method accomplishes pairing based on an image taken by the terminal 100.

In 810, the image verifier 220 of FIG. 2 may verify whether an image taken by the terminal 100 of FIG. 1 includes a hearing apparatus 105 or information associated with such a hearing apparatus 105.

For example, the image verifier 220 may compare the image taken by the terminal 100 to sample images of hearing apparatuses, for example, a front view, a side view, a top view, a bottom view, and/or a rear view of the hearing apparatus. Based on the comparison, the image verifier 220 may verify whether the image taken by the terminal 100 includes a hearing apparatus 105. Also, in response to an image taken by the terminal 100 including at least one of a QR code, a barcode, an advertisement, and an image on a storage case, the image verifier 220 may verify whether information included in the image is associated with the hearing apparatus 105 by transmitting, to a server related to the hearing apparatus 105, the QR code, the barcode, the advertisement, or the image on the storage case included in the image.

In the event that the image taken by the terminal 100 does not include the hearing apparatus 105 or the information associated with the hearing apparatus 105, the image verifier 220 may continuously perform 810 until the hearing apparatus 105 or the information associated with the hearing apparatus 105 is included in the image taken by the terminal 100. Also, in the event that the image taken by the terminal 100 includes the hearing apparatus 105 or the information associated with the hearing apparatus 105, a pairing function determiner 120 may perform 820.

In 820, the pairing function determiner 120 may determine whether the terminal 100 is in a state in which its pairing function may be used.

For example, in the event that the terminal 100 is performing a call function or is executing an application unrelated to pairing such as, for example, a video game application, the pairing function determiner 120 may determine that the terminal 120 is not in a state to make use of its pairing function.

In addition, in the event that the pairing function of the terminal 100 such as, for example, a Bluetooth pairing function, is in an off state in accordance with the settings set by the user in advance of initiating the pairing, the pairing function determiner 120 may determine that the pairing function of the terminal 100 is not in a condition to be used.

In the event that the terminal 100 is not in a state to make use of its pairing function, the pairing function determiner 120 may perform 830. Also, in the event that the terminal 100 is in a condition to make use of its pairing function, a pairing unit 130 may perform 850.

In the event that the terminal 100 is in a condition to make use of its pairing function because the terminal 100 is performing a call function or is executing an application unrelated to pairing such as, for example, a video game application, the terminal 100 may wait until the call function or the application is terminated. However, in the event that the pairing function of the terminal 100 is in an off state, the pairing function of the terminal 100 may be used by simply turning on the pairing function without a delay.

Thus, in 830, the pairing function determiner 120 may verify whether the pairing function of the terminal 100 is in its off state.

In response to the pairing function of the terminal 100 not being in an off state, the pairing function determiner 120 may terminate the operation, and a pairing event verifier 110 may continuously perform 820. That is, the pairing function determiner 120 may continually determine whether the terminal 100 is in a state in which its pairing function may be used. The pairing function determiner 120 may wait until the call function or the application is terminated. In addition, in the event that the pairing function of the terminal 100 is in its off state, the pairing function determiner 120 may perform 840.

In 840, the pairing function determiner 120 may turn on the pairing function of the terminal 100 to its on state, and may then determine that the terminal 100 is able to use its pairing function.

In 850, the pairing unit 130 may identify a type of the hearing apparatus 105 verified to be included in the image in 810.

The pairing unit 130 may compare the image taken by the terminal 100 to sample images of hearing apparatuses and may identify the type of the hearing apparatus 105 in the image. In the event that the image taken by the terminal 100 includes a QR code, a barcode, an advertisement, or an image on a storage case, the pairing unit 130 may transmit information included in the image to a server related to the hearing apparatus 105 and may identify the type of the hearing apparatus 105 that corresponds to the information included in the image.

In 860, the pairing unit 130 may pair the terminal 100 with the hearing apparatus 105 of the type identified in 850.

The pairing unit 130 may transmit a pairing attempt signal. In this example, the pairing attempt signal may correspond to the type of the hearing apparatus 105 identified in 850.

Among one or more hearing apparatuses that receive the pairing attempt signal, a pairable hearing apparatus may transmit a reply signal to the terminal 100 in response to the pairing attempt signal. In the event that the pairing attempt signal corresponds to the type of the hearing apparatus 105 identified in 850, the hearing apparatus 105 receiving the pairing attempt signal may be the hearing apparatus 105 included in the image. Accordingly, even if a plurality of hearing apparatuses are present within the reach of the pairing attempt signal, the terminal 100 may be paired with a hearing apparatus desired by the user by identifying a desired type of the desired hearing apparatus and performing the pairing based on the identified type of the hearing apparatus.

Subsequently, the terminal 100 may be paired with the hearing apparatus 105 that transmitted the reply signal in response to the pairing attempt signal.

Figure 9:
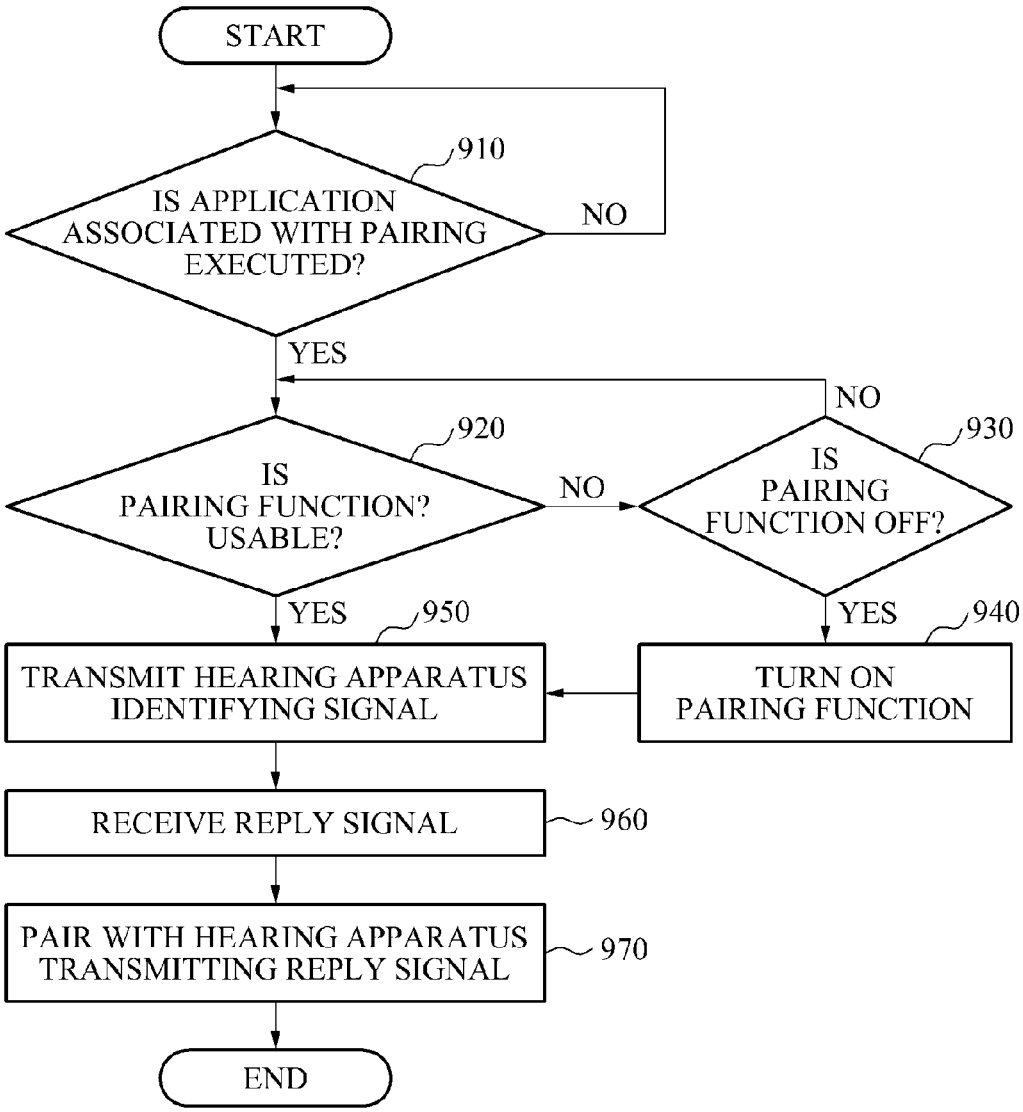
FIG. 9 is a flowchart illustrating another example of a method of pairing a terminal with a hearing apparatus.

FIG. 9 is a flowchart illustrating an example of a pairing method based on a signal.

In 910, the signal transceiver 230 of FIG. 2 may verify whether an application related to pairing is being executed.

In response to a determination that the application related to the pairing is not being executed in the terminal 100 of FIG. 1, the signal transceiver 230 may continuously perform the 910 until the application related to the pairing is executed. Also, in response to the application related to the pairing being executed in the terminal 100, a pairing function determiner 120 may perform 920.

In 920, a pairing function determiner 120 may determine whether a pairing function of the terminal 120 is in a usable state.

In the event that the terminal 100 is performing a call function or an application unrelated to the pairing, for example, a game, the pairing function determiner 120 may determine that the terminal 100 is not in a condition to make use of its pairing function.

Also, in the event that the pairing function of the terminal 100 such as, for example, a Bluetooth pairing function, is in its off state in accordance with the settings set by the user in advance, the pairing function determiner 120 may determine that the terminal 100 is not able to use its pairing function.

In the event that the terminal 100 is not able to use its pairing function, the pairing function determiner 120 may perform 930. Conversely, in the event that the terminal 100 is able to use its pairing function, the pairing unit 130 may perform 950.

In the event that the terminal 100 is not able to use the pairing function because the terminal 100 is performing a call function or is executing an application not related to the pairing such as, for example, a video game application, the terminal 100 may wait until the call function or the application is terminated. However, in the event that the pairing function of the terminal 100 is in its off state, the pairing function of the terminal 100 may be used by simply turning on the pairing function.

Thus, in 930, the pairing function determiner 120 may determine whether the pairing function of the terminal 100 is in its off state.

In the event that the pairing function of the terminal 100 is not in its off state, the pairing function determiner 120 may terminate the operation, and a pairing event verifier 110 may continuously perform 920. Also, the pairing function determiner 120 may wait until the call function or the application is terminated. In response to the pairing function of the terminal 100 being in its off state, the pairing function determiner 120 may perform 940.

In 940, the pairing function determiner 120 may set the pairing function of the terminal 100 to be in its on state and may determine that the terminal 100 is able to use the pairing function.

In 950, a signal transceiver 230 may transmit a hearing apparatus identifying signal. In this example, the hearing apparatus identifying signal may refer to an RF signal enabling the hearing apparatus 105 to receive the signal and to transmit a reply signal in response to the received hearing apparatus identifying signal.

In 960, the signal transceiver 230 may receive, from the hearing apparatus 105, the reply signal in response to the hearing apparatus identifying signal transmitted in 950.

In 970, a pairing unit 130 may pair the terminal 100 with the hearing apparatus 105 that transmitted the reply signal in 960.

The pairing unit 130 may transmit a pairing attempt signal to the hearing apparatus 105 that transmitted the reply signal.

In this example, among hearing apparatuses that receive the pairing attempt signal, a pairable hearing apparatus may transmit the replay signal to the terminal 100.

Subsequently, the terminal 100 may be paired with the hearing apparatus 105 that transmitted the reply signal in response to the pairing attempt signal from the terminal 100.

In addition, in response to the signal transceiver 230 transmitting the hearing apparatus identifying signal at a predetermined time interval, operations 950 through 970 may be performed at the predetermined time interval. Thus, the terminal 100 may search and locate the hearing apparatus 105 that transmitted the reply signal. In the event that the terminal 100 finds a hearing apparatus 105 is transmitting the reply signal, the pairing unit 130 may pair the terminal 100 with the hearing apparatus 105 that transmitted the reply signal.

The units described herein may be implemented using hardware components and software components. For example, the hardware components may include microphones, amplifiers, band-pass filters, audio to digital convertors, and processing devices. A processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums. The non-transitory computer readable recording medium may include any data storage device that can store data which can be thereafter read by a computer system or processing device. Examples of the non-transitory computer readable recording medium include read-only memory (ROM), random-access memory (RAM), CD-ROMs, magnetic tapes, floppy discs, optical data storage devices. Also, functional programs, codes, and code segments that accomplish the examples disclosed herein can be easily construed by programmers skilled in the art to which the examples pertain based on and using the flow diagrams and block diagrams of the figures and their corresponding descriptions as provided herein.

As a non-exhaustive illustration only, a terminal or device described herein may refer to mobile devices such as a cellular phone, a personal digital assistant (PDA), a digital camera, a portable game console, and an MP3 player, a portable/personal multimedia player (PMP), a handheld e-book, a portable laptop PC, a global positioning system (GPS) navigation, a tablet, a sensor, and devices such as a desktop PC, a high definition television (HDTV), an optical disc player, a setup box, a home appliance, and the like that are capable of wireless communication or network communication consistent with that which is disclosed herein.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A method of pairing a terminal, the method comprising:

verifying, based on a form of an object in physical contact with a touch display of the terminal, whether the object in contact with the terminal is a hearing apparatus; and pairing the terminal with the hearing apparatus in response to a determination that the hearing apparatus is in contact with the touch display of the terminal.

2. The method of claim 1, wherein the verifying comprises determining that the hearing apparatus is in contact with the touch display of the terminal in response to detecting a magnetic field induced by the hearing apparatus.

3. The method of claim 1, wherein the verifying comprises, in response to detecting a contact with the touch display of the terminal that is different from a contact of a body of a user with the touch display of the terminal, transmitting a hearing apparatus identifying signal and determining that the hearing apparatus is in contact with the touch display of the terminal after receiving a reply signal from the hearing apparatus.

4. The method of claim 1, further comprising:

determining whether the terminal is able to use a pairing function, wherein the pairing is performed in response to a determination that the terminal is able to use the pairing function.

5. The method of claim 4, wherein the determining comprises determining that the terminal is not able to use the pairing function in response to a determination that the terminal is performing an application unrelated to the pairing.

6. The method of claim 4, wherein the determining comprises determining that the terminal is not able to use the pairing function in response to a determination that the pairing function of the terminal is in an off state.

7. The method of claim 6, further comprising:

setting the pairing function of the terminal to be in an on state in response to the pairing function of the terminal being in an off state and determining that the terminal is able to use the pairing function.

8. The method of claim 1, wherein the pairing comprises transmitting a pairing attempt signal from the terminal and pairing the terminal with a hearing apparatus responding to the pairing attempt signal.

9. A method of pairing a terminal, comprising:

verifying, based on a comparison between an image taken by the terminal and sample images of hearing apparatuses, whether the image taken by a terminal comprises a hearing apparatus; and pairing the terminal with the hearing apparatus in response to the image taken by the terminal comprising the hearing apparatus or information associated with the hearing apparatus.

10. The method of claim 9, wherein the information associated with the hearing apparatus comprises at least one of a quick response code, a barcode, an advertisement, or an image on a storage case of the hearing apparatus.

11. The method of claim 9, wherein the pairing comprises:

identifying a type of the hearing apparatus using the image taken by the terminal;

transmitting a pairing attempt signal corresponding to the identified type; and pairing the terminal with a hearing apparatus responding to the pairing attempt signal.

12. The method of claim 9, wherein the image is taken by a single lens camera of the terminal that is not an infrared camera.

13. A non-transitory computer-readable storage medium comprising a program comprising instructions to cause a computer to perform the method of claim 1.

14. A terminal, comprising:

a hearing apparatus contact verifier configured to verify, based on a form of an object in physical contact with a touch display of the terminal, whether the object in contact with the terminal is a hearing apparatus; and a pairer configured to pair the terminal with the hearing apparatus in response to the hearing apparatus being in contact with the touch display of the terminal.

15. The terminal of claim 14, wherein the hearing apparatus contact verifier is configured to determine that the hearing apparatus is in contact with the touch display of the terminal in response to a magnetic field induced by a magnet disposed in the hearing apparatus being detected by a magnetic sensor.

16. The terminal of claim 15, wherein the hearing apparatus contact verifier is configured to verify whether the hearing apparatus is in contact with the touch display of the terminal in response to a touch being detected through a touch screen of the touch display of the terminal.

17. The terminal of claim 16, wherein the hearing apparatus contact verifier is configured to, in response to detecting the touch through the touch screen, determine whether the touch is different from a contact with a body of a user and transmit a hearing apparatus identifying signal in response to a determination that the touch is different.

18. The terminal of claim 14, further comprising:

a pairing function determiner configured to determine whether the terminal is able to use a pairing function, wherein the pairer is configured to pair the terminal with the hearing apparatus in response to the pairing function determiner determining that the terminal is able to use the pairing function.

19. A terminal comprising:

a camera;

an image verifier configured to verify, based on a comparison between an image taken by the terminal and sample images of hearing apparatuses, whether the image taken by the camera comprises a hearing apparatus; and a pairer configured to pair the terminal with the hearing apparatus in response to the image verifier determining that the image taken by the camera comprises the hearing apparatus or the information associated with the hearing apparatus.

20. The terminal of claim 19, wherein the camera is a single lens camera that is not an infrared camera.

21. The terminal of claim 19, wherein the information associated with the hearing apparatus comprises at least one of a quick response code, a barcode, an advertisement, or an image on a storage case of the hearing apparatus.

22. The terminal of claim 19, wherein the image verifier is further configured to receive information on a type of the hearing apparatus from a server.

* * * * *